United States Patent [19]

Goguen

[11] 4,385,698

[45] May 31, 1983

[54] CORNER PROTECTING DEVICE

[75] Inventor: George J. Goguen, Reading, Mass.

[73] Assignee: Container Corporation of America, Chicago, Ill.

[21] Appl. No.: 366,716

[22] Filed: Apr. 8, 1982

[51] Int. Cl.[3] ..... B65D 81/02; B65D 85/30

[52] U.S. Cl. ..... 206/586; 206/453; 206/454; 206/588

[58] Field of Search ..... 206/586, 588, 521, 585, 206/453, 445, 454; 229/DIG. 1; 211/72, 73; 248/345.1

[56] References Cited

U.S. PATENT DOCUMENTS

| | | | |
|---|---|---|---|
| 1,821,692 | 9/1931 | Copeland | 206/586 |
| 2,000,158 | 5/1935 | Black et al. | 205/586 |
| 2,324,031 | 7/1943 | Schiffenhaus | 206/586 |
| 2,337,468 | 12/1943 | Hilger | 206/454 |
| 2,410,591 | 11/1946 | Turner | 206/586 X |
| 2,603,349 | 7/1952 | Antwerpen | 206/453 |
| 2,626,050 | 1/1953 | Freiberg | 206/453 |
| 2,663,417 | 12/1953 | Kincaid | 206/590 |
| 2,681,733 | 6/1954 | Welshenbach | 206/453 |
| 2,684,153 | 7/1954 | Freiberg | 206/453 |
| 2,740,574 | 4/1956 | Laver | 206/588 X |
| 3,086,689 | 4/1963 | Wiedenmeier | 206/586 X |
| 3,095,970 | 7/1963 | Gaulke | 206/586 X |
| 3,946,868 | 3/1976 | Rutter | 206/586 X |
| 4,000,843 | 1/1977 | Sorenson et al. | 206/586 |
| 4,127,192 | 11/1978 | Card | 206/586 |
| 4,134,496 | 1/1979 | Smith | 206/453 |
| 4,143,766 | 3/1979 | Goulde | 206/453 |
| 4,194,630 | 3/1980 | Kaiser | 206/586 |
| 4,238,031 | 12/1980 | Skaggs | 206/453 |

*Primary Examiner*—Steven M. Pollard
*Assistant Examiner*—Bryon Gehman
*Attorney, Agent, or Firm*—Richard W. Carpenter; Davis Chin

[57] ABSTRACT

A one-piece corner protecting device formed of foldable paperboard for use within an outer package.

5 Claims, 3 Drawing Figures

CORNER PROTECTING DEVICE

BACKGROUND OF THE INVENTION

1. Field of the Invention

This invention relates generally to packaging inserts formed of paperboard, and more particularly to a device for protecting a corner portion of a packaged article within an outer container.

2. Description of the Prior Art

A prior art search directed to the subject matter of this application in the U.S. Patent and Trademark Office revealed the following U.S. Pat. Nos.: 1,821,692; 2,000,158; 2,324,031; 2,337,468; 2,410,591; 2,603,349; 2,626,050; 2,663,417; 2,681,733; 2,684,153; 2,740,574; 3,064,801; 3,086,689; 3,095,970; 3,946,868; 4,000,843; 4,127,192; 4,134,496; 4,143,766; 4,194,630.

None of the prior art patents uncovered in the search disclosed a corner protection device which includes a pair of panels having sandwiched therebetween a pair of U-shaped pocket members spaced from each other to provide therebetween an opening for receiving a portion of the packaged article.

SUMMARY OF THE INVENTION

It is the purpose of this invention to provide a corner protecting device of simple design and construction which is formed of paperboard and which may be easily erected from a flat blank.

A more specific object of the invention is the provision of a corner protecting device, formed from a unitary blank of foldable paperboard, which has a pair of flat retaining panels between which are sandwiched a pair of U-shaped pocket members for receiving portions of a packaged article.

These and other objects of the invention will be apparent from an examination of the following description and drawings.

DESCRIPTION OF THE PREFERRED EMBODIMENT

Figure 3:
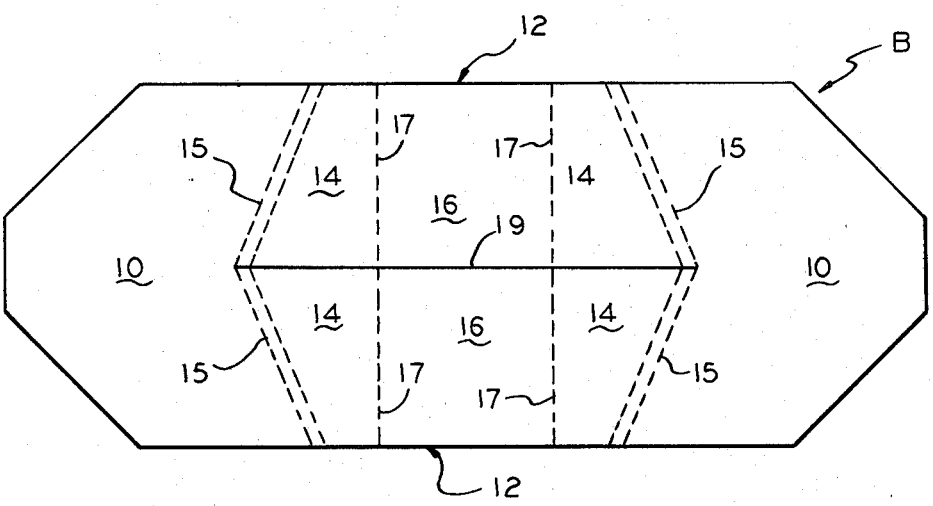
FIG. 3 is a plan view of a blank of foldable sheet material from which the corner protection device illustrated in the other views may be formed.
Figure 1:
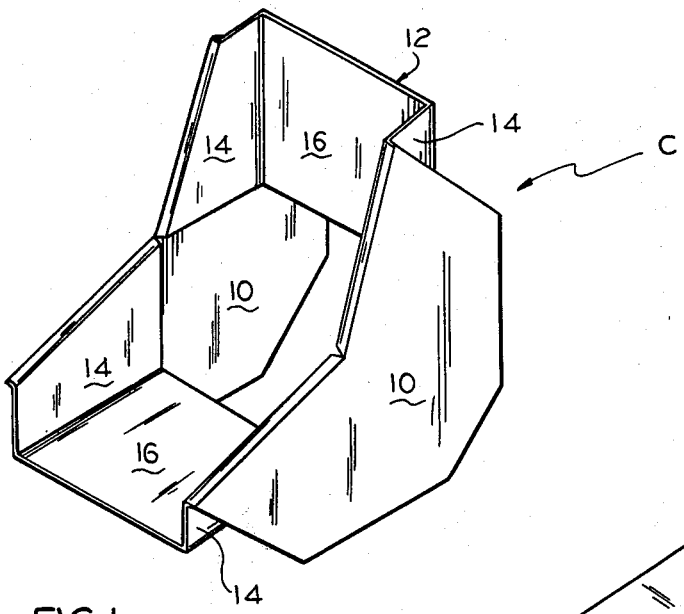
FIGS. 1 and 2 are perspective views, as seen from the inside and outside, respectively, of a corner protecting device embodying features of the invention.
Figure 2:
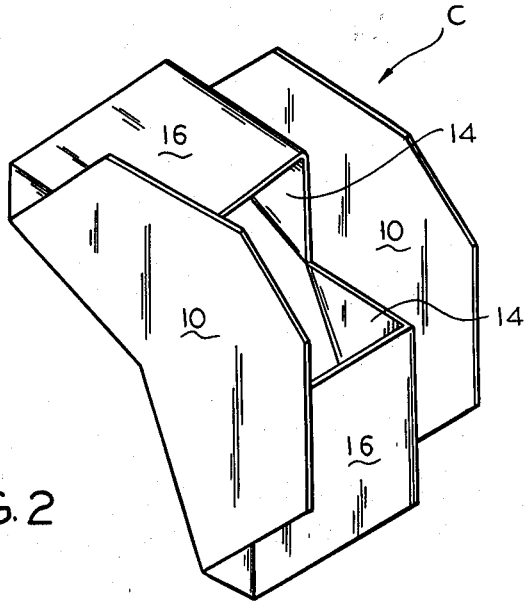

Referring now to the drawings for a better understanding of the invention, it will be seen that the novel corner protecting device, indicated generally at C in FIGS. 1 and 2, may be formed from the unitary blank B of foldable paperboard illustrated in FIG. 3.

The corner protecting device includes a pair of flat outer retaining panels 10 which are spaced from each other in parallel relationship and which have interposed therebetween a pair of generally U-shaped pocket members indicated generally at 12.

It is contemplated that the outer panels 10 are adapted to be positioned against opposed inner surfaces of an outer shipping container or wrapper (not shown), and the pocket members 12 of the device are adapted to receive and engage portions a packaged article (not shown) adjacent the corner of the article to hold it in place and prevent the corner of the article from coming in contact with the outer package or container.

Each of the pocket members 12 includes a pair of trapezoid shaped side panels 14, which are foldably joined along fold lines 15 to adjacent edges of related outer retaining panels 10, and a preferably rectangular center panel 16, which is foldably joined at its opposite side edges along fold lines 17 to adjacent edges of related side panels 14. If desired, fold lines 15 may be double score lines to accomodate the easy folding of the various elements in relation to each other.

As best seen in FIG. 3 the pocket members 12 are separated from each other in the blank B by means of a cut line 19 extending longitudinally of the blank between opposed fold lines 15.

In order to assemble the device, all that is required is to grasp the two outer retaining panels 10 and fold them toward each other until they are in spaced parallel relationship with each other. As this happens the pocket members 12 will automatically be formed into U-shaped structures interposed between the outer retaining panels, as best seen in FIGS. 1 and 2.

Thus it will be appreciated that the invention provides a relatively simple and inexpensive structure which may be formed from a unitary blank of foldable paperboard and which is automatically erectable when opposite ends of the device are grasped and moved into parallel relation.

What is claimed is:

1. An automatically erectable, corner protecting device for use in providing a space between an outer corner of a packaged article and an inner corner of an outer shipping container or wrapper, said device being formed from a unitary blank of foldable sheet material such as paperboard and comprising:

(a) a pair of outer retaining panels disposed in spaced parallel relationship with each other and adapted for engagement with inner surfaces of container side walls;

(b) an inner section interposed between said outer retaining panels and being adapted for engagement with outer surfaces of a packaged article adjacent a corner portion thereof;

(c) said inner section including a pair of generally U-shaped pocket members spaced from each other, to define therebetween an opening for receiving a corner portion of a packaged article, each of said pocket members including:

(i) a pair of side panels foldably joined along first side edges to corresponding edges of respective outer retaining panels on parallel fold lines;

(ii) a center panel foldably joined at opposite side edges to second side edges of respective side panels on parallel fold lines.

2. A device according to claim 1, wherein corresponding side panels of the respective pocket members being disposed in face-to-face relation with related outer retaining panels and joined thereto on fold lines which converge between said pocket members.

3. A device according to claim 1, wherein said pocket member center panels are generally rectangular, and said pocket member side panels are generally trapezoidal.

4. A device according to claim 1, wherein respective pocket member center panels are disposed in planes extending normal to each other.

5. A blank of foldable sheet material, such as paperboard, which is cut and scored to be formed into a corner protecting device for use in packaging, said blank being generally elongated in shape and comprising:

(a) a pair of outer retaining forming panels located at opposite ends of said blank and separated from each other by a center section of the blank;

(b) said center section including a pair of sets of pocket member forming panels separated from each other by a cut line extending longitudinally of the blank;

(c) each of said pocket member forming sets including:

(i) a center panel;

(ii) a pair of end panels having inner edges foldably joined to opposite side edges of the center panel on parallel fold lines and having outer edges foldably joined to related side panels on fold lines that diverge toward the center of the blank.

* * * * *